US005129628A

United States Patent [19]

Vesper

[11] Patent Number: 5,129,628

[45] Date of Patent: Jul. 14, 1992

[54] FENCE PANEL AND WALL CONSTRUCTION

[76] Inventor: Dale E. Vesper, 873 Fox Spring Dr., Chesterfield, Mo. 63017

[21] Appl. No.: 455,061

[22] Filed: Dec. 22, 1989

Related U.S. Application Data

[63] Continuation-in-part of Ser. No. 178,261, Apr. 6, 1988.

[51] Int. Cl.[5] ..... E04H 17/16

[52] U.S. Cl. ..... 256/31; 256/73; 256/DIG. 5; 52/793; 52/309.7; 52/881

[58] Field of Search ..... 256/19, 24, 31, 73, 256/DIG. 5; 52/793, 309.7, 309.17, 809, 281, 779

[56] References Cited

U.S. PATENT DOCUMENTS

| | | | |
|---|---|---|---|
| 2,039,601 | 5/1936 | London | 52/781 |
| 2,040,578 | 5/1936 | Venzie | 52/779 X |
| 2,414,628 | 1/1947 | Battin | 52/781 X |
| 2,664,740 | 1/1954 | Cochrane . | |
| 2,960,196 | 11/1960 | Meserole | 52/809 |
| 3,196,499 | 7/1965 | Houvener | 52/809 |
| 3,381,483 | 5/1968 | Huthsing, Jr. | 256/19 X |
| 4,193,584 | 3/1980 | Wieser | 256/19 |
| 4,288,962 | 9/1981 | Kavanaugh . | |
| 4,649,682 | 3/1987 | Barrett, Jr. . | |
| 4,712,352 | 12/1987 | Low | 52/809 |

FOREIGN PATENT DOCUMENTS

| | | | |
|---|---|---|---|
| 0003597 | of 1926 | Australia | 256/24 |
| 0348078 | 3/1905 | France | 52/779 |
| 0057468 | 6/1911 | Switzerland | 52/779 |
| 0001706 | of 1876 | United Kingdom | 52/779 |
| 0241634 | 4/1925 | United Kingdom | 52/779 |

*Primary Examiner*—Andrew V. Kandrat
*Assistant Examiner*—Carol I. Bordas

[57] ABSTRACT

Fence wall construction including panels of polymeric material. The vertical edges of such panels are slotted to accomodate flanges of upright supporting posts. The horizontal edges of such panels are slotted to accommodate added reinforcing flanges. A fence wall is made up of a row of flanged posts, adjacent posts being spaced the width of a panel apart, with each pair of posts having a panel interposed, with the post flanges inserted substantially entirely within the slots on the panel vertical edges and thereby concealed.

5 Claims, 5 Drawing Sheets

FENCE PANEL AND WALL CONSTRUCTION

This is continuation-in-part a of my copending application, Ser. No. 178,261 filed Apr. 6, 1988, which is incorporated herein by this reference.

FIELD OF THE INVENTION

This invention relates to construction of fence walls for physical and visual separation of adjacent sites, and concerns particularly increased durability and increased economy of such walls.

BACKGROUND OF THE INVENTION

Most fences and walls, including fence walls, look fine when just installed. However, many tilt, sag, and crack as time passes and the underlying support shifts slightly under the weight of the materials used. There is a need for a more durable structure, and some innovators have made related contributions. Cochrane in U.S. Pat. No. 2,664,740 discloses I-beam posts with hardware to retain his panel members. Totten in U.S. Pat. No. 4,007,919 teaches hollow I-beam posts with interlocking hollow rails filled with plastic. Kavanaugh in U.S. Pat. No. 4,288,962 discloses a wall made by affixing plasterboard to the exterior of aligned flanges (perforated) of metal I-beams, and spraying plastic foam to coat the adjacent surface of such board and flanges until flush, and finally coats the exterior with adhesive and then with stucco. However, these approaches fail to provide the combination of features that my invention offers.

SUMMARY OF THE INVENTION

In general, the objects of the present invention are met placing a plurality of flanged fence posts upright and on centers spaced apart at successive intervals, providing a plurality of wall panels of such interval length with slots along their end edges to receive such post flanges, and inserting such panels between adjacent pairs of such posts with such flanges received substantially entirely within such slots. In one embodiment such panels are slotted similarly (but slightly offset) along their top and bottom edges, to receive reinforcing channel members therein. The panels are coated in place with a layer of cementitious material, after being covered with wire screen anchored to the fence posts in some embodiments.

A primary object of this invention is to provide a more durable fence wall than is conventionally available.

Another object of the invention is to provide a unique combination of lightness in weight and strength of result.

A further object is to improve the appearance of fence walls useful as screens or buffers in many neighborhoods.

Yet another object is to accomplish the foregoing objects more economically than lesser results are attained nowadays.

Other objects of this invention, together with means and methods for attaining the various objects, will be apparent from the following description and the accompanying diagrams, which are presented by way of example rather than limitation.

DETAILED DESCRIPTION

Figure 2:
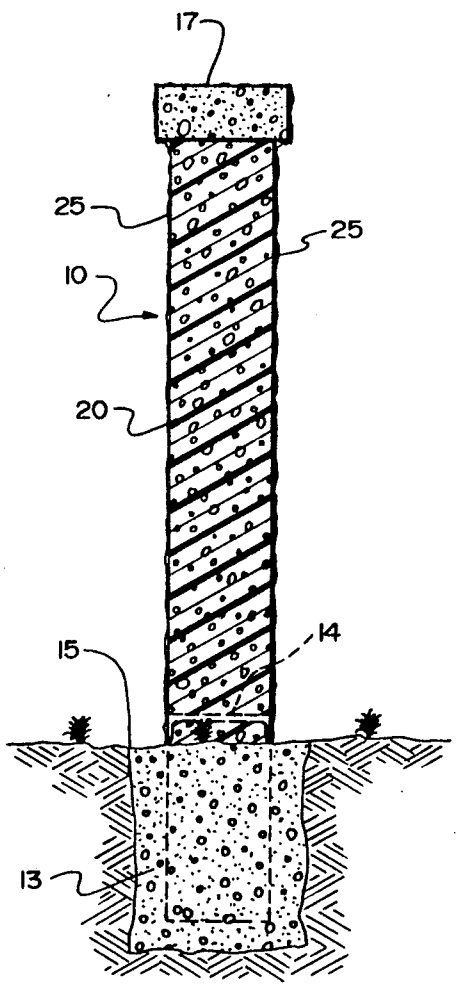
FIG. 2 is a transverse section through such a wall, between supporting posts.
Figure 1:
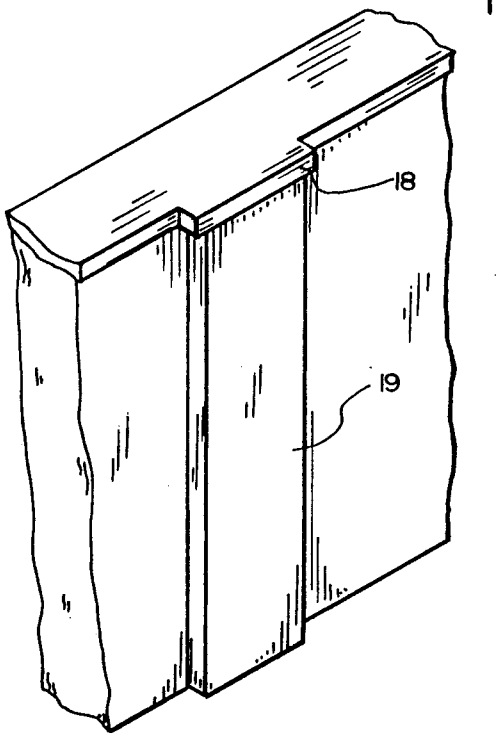
FIG. 1 is a perspective view of a fence wall of this invention.
Figure 1:
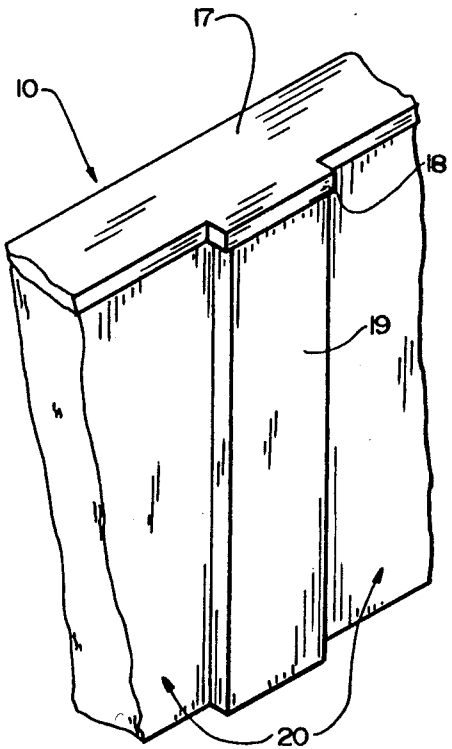

FIG. 1 shows in perspective a relatively short section of a fence wall 10 of this invention. FIG. 2 shows the same structure in transverse section through such a panel. Such fence features a succession of panels 20 upstanding above ground level 15. Each pair of adjacent panels has a supporting post 12 intervening but invisible from the exterior. Each such post extends also below ground into a footing 13. Cap 17, shown with occasional sidelong rectangular extensions 18 to the near side, overlies the fence wall of FIGS. 1 and its similarly located decorative pilasters 19.

In sectional FIG. 2 the cap is shaded for concrete or stone, the panel for foamed plastic, and the footing for concrete. At about ground level, stop 14 in the form of an inverted transverse channel piece fits within and is secured, as by welding, to a vertical channel of the post to support the adjacent end of the near panel.

The opposite channel on the far side of the post has a like stop (not shown). Both sides of the panel are covered by protective material 25, shown with an irregular stucco-like surface.

Figure 3:
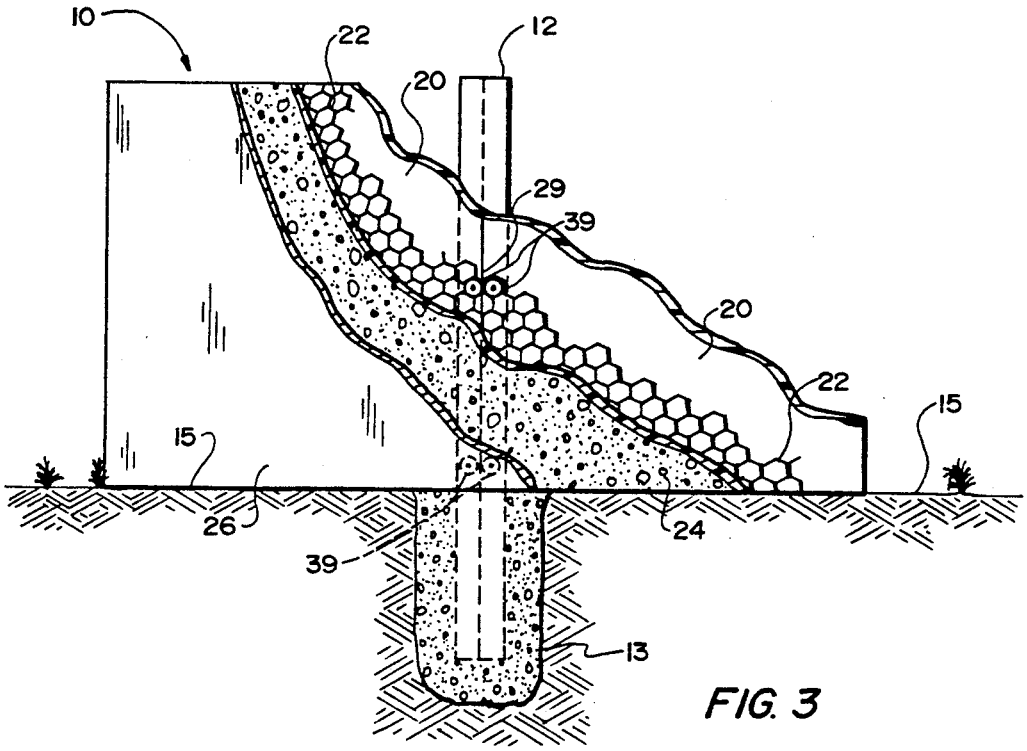
FIG. 3 is a fragmentary side elevation of the same fence wall (omitting any cap portion) successively cut away intermediately to show layered, components and sectioned underground.
Figure 4:
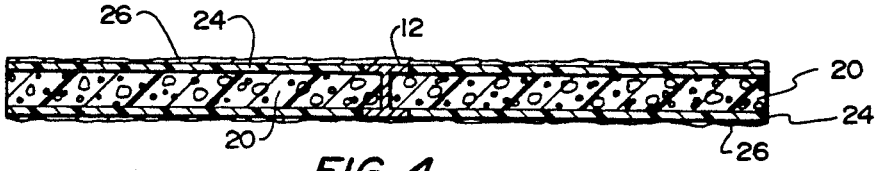
FIG. 4 is a sectional plan of a portion of the same fence wall; constructed with the panel embodiment of FIG. 10 in the vicinity of a post.

FIG. 3 shows, in successively cut-away layers, and FIG. 4 in fragmentary sectional plan, part of fence wall 10 (less cap). Pair of panels 20 flank single post 12 (upstanding from footing 13) with the adjacent edges of their visible surfaces abutting one another along vertical slit 29. Open-mesh reinforcing fabric or screen 22 covers the panel surface, being anchored to the posts by suitable means such as overlying flat-headed self-tapping screws 39 driven at intervals into the post flanges. Layered protective material (formerly denoted generally as 25) on the outer surface of panels 20 is shown here as made up of inner layer or base coat 24 of cementitious material (described below) covered in turn by optional outer layer or finish coat 26 of finer or differently colored material (also considered below).

Figure 5:
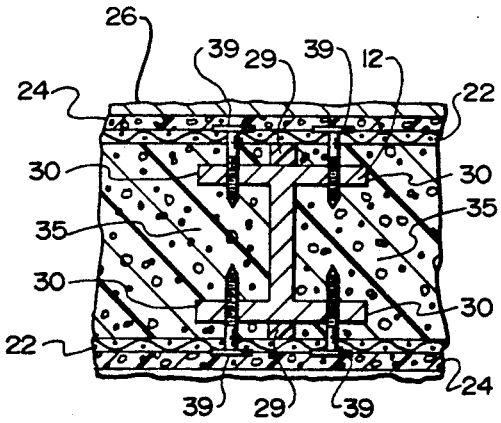
FIG. 5 is a detail view of the fence wall portion of FIG. 4.

FIG. 5 is an enlarged detail view of the post and vicinity of FIG. 4, showing post 12 to have an H-shaped transverse cross-section; such a double channeled member is often called an "I-beam" and is a common item in many kinds of construction. Although not so shown here, such post may be composed of two channel members (C-shaped in section) secured together back to back. Panels 20 at its opposite sides are doubly slotted vertically on their ends to receive the two side flanges of the post I-beam, with tenon 35 between slots 30 fitting into the respective adjacent channels. The overlying or outer surface portions of the panels abut one another along their edges with slit 29 therebetween, covered by open-mesh fabric 22, and all overlain in turn by respective inner and outer layers of protective material 24 and 26.

Figure 6:
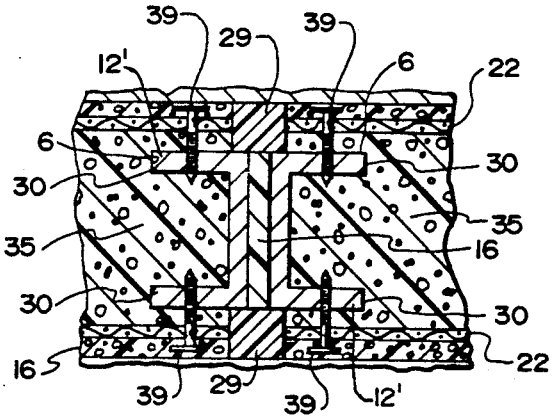
FIG. 6 is a similar detail view with another post embodiment.
Figure 7:
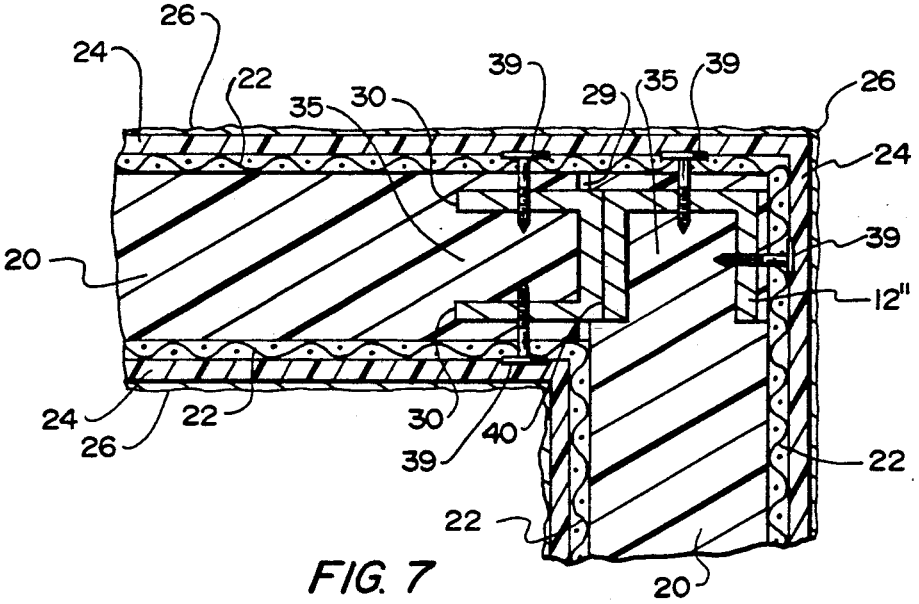
FIG. 7 is a similar detail view of a corner post embodiment.

FIGS. 6 and 7 are similarly enlarged detail views of other, composite posts of this invention and their immediate vicinity in sectional plan. Thus, FIG. 6 shows post 12' as made up of a pair of single-channeled members 6, each having a C-shaped cross-section, arranged back-to-back and spaced apart as an expansion-joint, with elastic strip 16 therebetween. Such strip is covered laterally by bead 38 of caulking material to fill the gap between panel ends. Such expansion-joint construction is useful at intervals along a fence wall, as at about every hundred feet (more or less), so as to compensate for temperature-induced changes in length.

FIG. 7 shows a pair of such simple C-shaped channel members secured together, as by welding, with the base of one covering the outside wall of a channel of the other and contiguous therewith. End portions of panels 20 fit onto the respective pairs of flanges to form a corner of the fence wall. End portions of both panels outside the corner preferably extend farther than corresponding inside end portions, or gaps can be filled by adding thin pieces of panel material for continuity of the wall corner surfaces.

Figure 8:
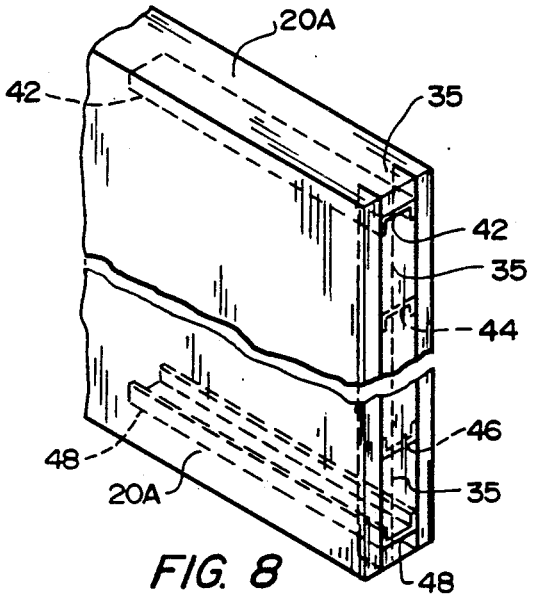
FIG. 8 is a fragmentary perspective view of another panel, with internal reinforcement.

FIG. 8 shows in perspective modified wall panel **20*a*, which has embedded within its plastic foam body an upright lower channel 48 and an inverted upper channel 42 for reinforcement. Indicated in broken lines are similar intervening upper and lower channels 44 and 46. The outside embedded channel width is narrow enough not to interfere with slotting of the vertical edges of such panel to receive the post flanges just as before. Reinforcing screen is absent as the channels enable the panels to carry the weight of the protective layers quite handily. Lower embedded channel 48** also limits the potential distortion of the bottom edge of the panels at the stops in the post flanges when carrying the coating weight.

Figure 9:
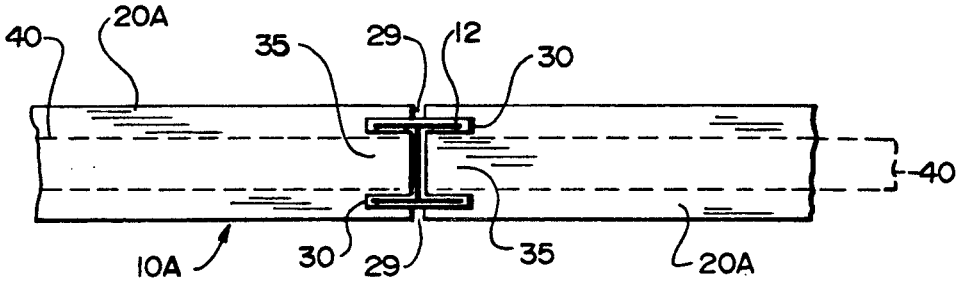
FIG. 9 is a fragmentary plan of FIG. 8 panels, flanking a post, thereby forming another fence wall embodiment of this invention.

FIG. 9 shows from above, fragmentarily and without any cap, straight fence wall **10*a*, comprising alternative panels 20*a* fitted to I-beam post 12, with the flanges of the post within the slots in the vertical edges of the respective panels. Coating is omitted as superfluous to illustration at this stage of assembly. Upper channel 42** is indicated in broken lines.

Figure 10:
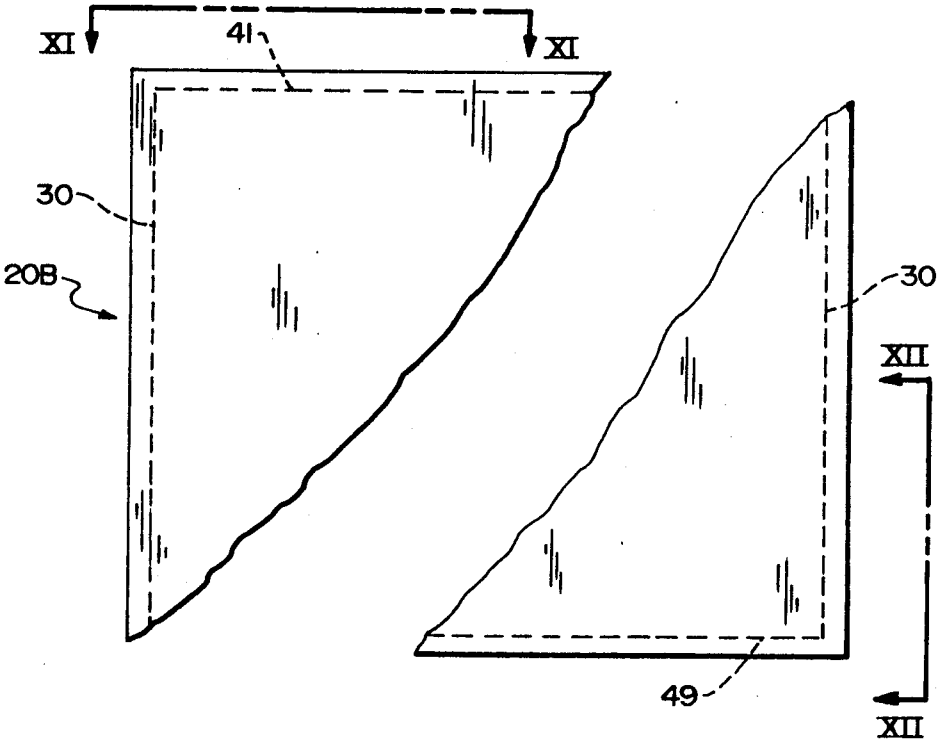
FIG. 10 is a side elevation of a panel embodiment adapted to receive reinforcing.

FIG. 10 shows third wall panel embodiment **20*b* cut away from the lower left to the upper right to conserve space. It will be understood that this panel is symmetrical about its horizontal bisector (not indicated). Suggested by broken lines paralleling respective peripheral edges are vertical slots 30 (a spaced pair along each such edge), upper horizontal slots 41, and lower horizontal slots 49** (a spaced pair along each such edge), shown more clearly edge-on in the next couple views.

Figure 11:
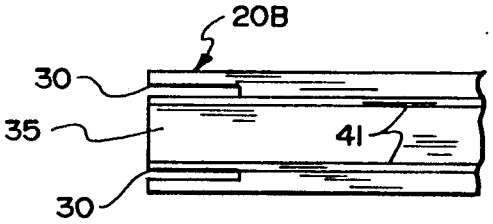
FIG. 11 is a fragmentary panel plan, taken at XI—XI on FIG. 10.

FIG. 11 shows, in plan, an upper left corner portion of panel **20*b*, with pair of vertical slots 30 spaced apart by the separation of the flanges of an I-beam (not shown in this view) flanking tenon 35, and with pair of horizontal slots 41** spaced apart just within the separation of the vertical slots and being also individually somewhat narrower than the individual vertical slots, to receive the smaller flanges of a reinforcing channel (inverted) shown later.

Figure 12:
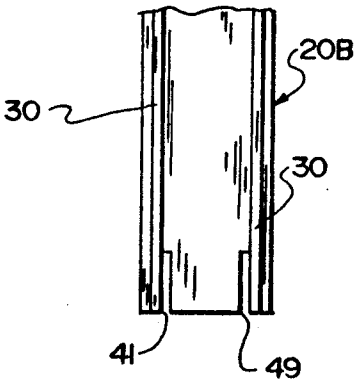
FIG. 12 is a fragmentary elevation of the last panel embodiment taken at XII—XII on FIG. 10.

FIG. 12 shows, in end elevation, a lower right corner portion of panel 20B, with pair of vertical slots 30 intersecting pair of wide slots 41 flanking tenon 45 near and at the bottom of the panel. It will be apparent that at a corner, as in FIG. 12, a gap equals the combined widths of slot 30 (for an I-beam flange) and a narrower slot for a reinforcing horizontal channel flange extending upward in the bottom edge of the panel just as slot 41 in FIG. 11 extended downward into its correspondingly slotted top edge.

Figure 13:
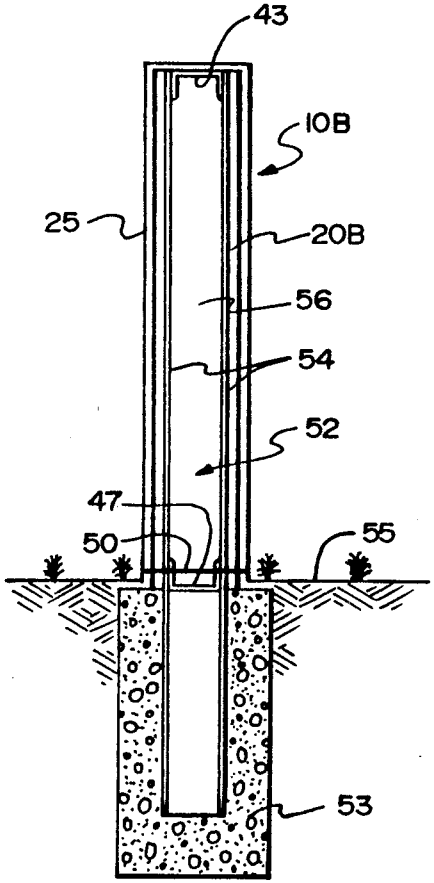
FIG. 13 is a sectional elevation of a fence wall containing panels of the several preceding views in the vicinity of a post.

FIG. 13 shows, in transverse sectional elevation (partly broken away to conserve space) fence wall 10B containing panels 20B of the several preceding views and at a post location. Concrete footing 53 below ground level 55 surrounds and supports the lower part of I-beam 52, which has pair of vertical flanges 54 spaced apart on web 56 and oriented edge-on to the viewer. As the flange spacing is less than the thickness of panel 20B, which is slotted to receive the flanges, narrow strips of the panel are visible flanking the flanges. The panel in turn is surrounded (except on its bottom) by stucco layer 25.

Visible just below the stucco layer, at the top of FIG. 13, is channel 43, inverted with its flanges extending downward into receptive slots (43) shown previously but not separately visible here. Similarly visible just above the footing is channel 47, with its flanges extending upward into like receptive slots shown previously but not separately visible here. It will be apparent that the flanges of the reinforcing channels fit at their ends within the flanges of the post I-beams. Presence of channel(s) 47 on the top of the footing renders unnecessary a separate channel piece (as 14, before) there to support the weight of the panel without distortion.

Figure 14:
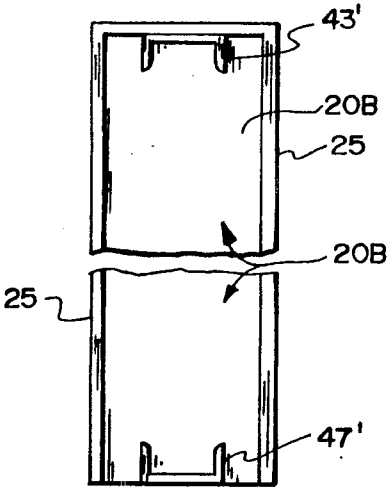
FIG. 14 is a sectional elevation of the fence wall of FIG. 13 at a location between posts, before being covered.

FIG. 14 shows fence wall 20B in sectional elevation, enlarged relative to FIG. 13, and with an intermediate portion cut away, at a location between posts. Reinforcing channels 43 and 47 are more readily visible here than in the preceding views but because of the intermediate location of this view no post member is shown.

Figure 15:
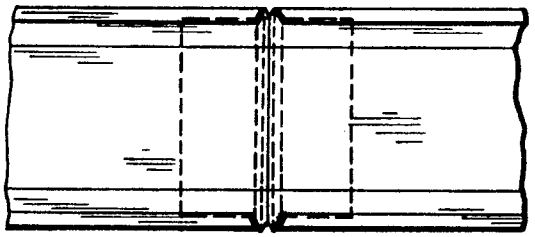
FIG. 15 is a plan view of part of the fence wall FIGS. 13 and 14, in the vicinity of a post.

FIG. 15 is a plan view of part of fence wall 20B of FIGS. 13 and 14, in the vicinity of a post, at the junction of a pair of wall panels 20B, 20B' flanking I-beam 52. It is apparent that the ends of the panels accommodate substantially the entire flanges of the I-beam, leaving only narrow vertical slit 59 between their ends. The slit can be filled with resilient sealant material, covered with tape, or both (or neither). Post cover 60 (dashed) may be placed on top before stucco is applied to the top or a cap is placed thereon.

Not shown in the foregoing views are corner constructions other than rectangular, but it will be apparent that a pair of channels can be secured to one another at other angles and/or the space in between be filled to make a smooth oblique wall junction. The materials used in construction of such fence walls of this invention are all made from conventional components and readily available in the marketplace. For example, the posts are conveniently metallic. Such posts, usually galvanized steel, are suitable in 18 gauge up to about 6 feet in fence height and 10 feet in post length (including underground portion), and in suitably heavier gauges (such as 8 to 16) to about 10 feet high and 16 feet long, dependent upon soil type and wind velocity as well as fence height. The base of each post is embedded in a cylindrical concrete footing about a foot in diameter.

The panels are made of suitable foamed polymeric composition, such as expanded polystyrene or polyurethane (more expensive). They may be slotted either in the process of manufacture or subsequently. The caps are made of similar, preferably unfoamed, polymeric material, or they may be made of stone or other appropriate material. They are secured by mortar or in any other suitable manner. Decorative horizontal or vertical extensions (strips or pilasters) of like or similar material may be added as well.

The inner layer or base coat—which may be the only one—of a low-alkali portland cement base, plus admixture of a subprotective material usually is a mainly a cementitious grout, with a substantial part of elastomeric polymer, such as a vinyl-acrylic or an epoxy resin, preferably reinforced by fibrous material mixed thereinto, such as glass or polyalkylene fibers, plus an expansible siliceous or other mineral aggregate capable of reducing the density of the resulting product.

The reinforcing fabric may be made of metallic wire, glass, or polymeric composition, as preferred, in any suitably open-mesh form. In overall appearance, the fence walls of this invention are as attractive as those made in any other way. They require less maintenance because they do not crack in the manner of concrete block walls (when the ground supporting them shifts underneath).

The weight of the walls of this invention is carried by the posts, which are in footings massive and extensive enough not to shift. Such walls may be made to follow the grade or may bridge swales, culverts, or like gaps by increasing post length if necessary and building up supporting stops in down-grade posts to level the panels. In performance, the fence walls of this invention meet and usually exceed the customary requirements for impact strength, wind resistance, and other physical characteristics. Although new and somewhat unorthodox, these fence walls have now been approved by many authorities, especially in the southeastern states, where high winds (and waters) and strong sun exposure impose unusually severe demands upon fencing and walls, particularly fence walls.

Variants on the basic fence wall structure of this invention have been suggested also. Other modifications made be made, as by adding, combining, or subdividing parts or steps while retaining some of the advantages and benefits of the invention, which itself is defined in the following claims.

The claimed invention:

1. An improved wall panel comprising polymeric material and having two mutually parallel outer vertical faces of given height, given width, and given thickness, bounded along their perimeter by a pair of vertical side edges and an interconnecting pair of horizontal top and bottom edges, each side edge having therein a pair of parallel slots to a first given depth, being spaced from the respective vertical faces, and being spaced apart from one another by a first slot-spacing width, the respective pairs of side edge slots being adapted to receive therein and cover the flanges of vertical channel members;

the top and bottom edges having therein a pair of parallel slots to a second given depth, being spaced from the respective faces, and being spaced apart from one another by a second slots-spacing width, the respective pair of top and bottom slot being adapted to receive therein and cover the flanges of horizontal channel members, the first and second slot-spacing widths being sufficiently similar that they merge to constitute a single pair of slots at the corners of the panels, and being sufficiently dissimilar in that when the flanges are received in the vertical side edge slots and when the flanges are received in the horizontal top or bottom slots respective flanges overlap one another at the panel corners, and the first slot-spacing width exceeding the second slot-spacing width whereupon the inner surface of flanges when in the vertical slots overlaps the other surface of flanges when in the horizontal top and bottom slots at the corners of the panels.

2. An improved wall panel according to claim 1, installed between a pair of upright posts having channels with their respective pairs of flanges facing one another in mutual alignment, the flanges of one post fitting substantially entirely within the pair of slots in one vertical edge of the panel, the flanges of another post fitting substantially entirely within the pair of slots in either side edge of the panel, and each such flange extending substantially entirely from the top edge of the bottom edge of the panel, whereupon the flanges in the vertical side edges and the flanges in the horizontal top and bottom edges overlap at the corners of the panels, and including means securing the overlapping flanges together.

3. Fence wall comprising a wall panel according to claim 2 fitted between two upright posts spaced apart the panel length, each post having a pair of parallel flanges aligned with the flanges of the other post and received into the panel side edge slots.

4. Fence wall according to claim 3, wherein both the top and bottom edges of the panel have flanges of channel members therein.

5. Fence wall according to claim 3, including one or more additional upright posts, the first additional post having such a panel aligned between it and the closest preceding post, spaced a panel length apart, with parallel aligned flanges on the respective posts and with a panel fitted between adjacent posts so aligned.

* * * * *